United States Patent [19]

Chitis

[11] 4,060,994

[45] Dec. 6, 1977

[54] PROCESS FOR PROVIDING A FOUNDATION PILE FOR ALTERNATING COMPRESSIVE AND TRACTIVE STRESSES AND A PILE THUS PROVIDED

[75] Inventor: Wolf Chitis, Naples, Italy

[73] Assignee: Fondedile S.p.A., Naples, Italy

[21] Appl. No.: 739,084

[22] Filed: Nov. 5, 1976

[30] Foreign Application Priority Data

Nov. 11, 1975 Italy ..... 40427/75

[51] Int. Cl.[2] ..... E02D 5/44

[52] U.S. Cl. ..... 61/53.6; 52/155; 61/53.62; 61/53.52

[58] Field of Search ..... 61/53.6, 53.62, 53.5, 61/35, 53.54, 53.52; 52/155

[56] References Cited

U.S. PATENT DOCUMENTS

| | | | |
|---|---|---|---|
| 3,241,325 | 3/1966 | Simons | 61/53.6 |
| 3,492,823 | 2/1970 | Lamberton | 61/53.6 |
| 3,496,729 | 2/1970 | Pleuger | 61/53.6 |
| 3,795,113 | 3/1974 | Chitis | 61/36 R |

*Primary Examiner*—Paul R. Gilliam
*Assistant Examiner*—A. Grosz
*Attorney, Agent, or Firm*—Bacon & Thomas

[57] ABSTRACT

The invention is related to a process according to which at the end of reinforcement bars inserted in a pile a nearly cylindrical and elongated chamber is inserted in the ground, said chamber having rigid impervious walls as to the fluids tending to enter from the outside, while when injecting cement grout into said chamber through appropriate tubes, the side walls will break and allow for grout expansion into the ground. The injection operation can be repeated for several times after as many scavengings or washings of the chamber.

6 Claims, 7 Drawing Figures

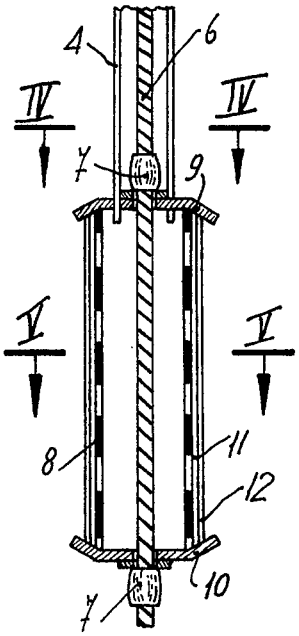
FIG. 3
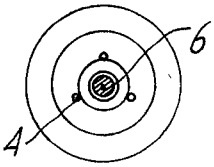
FIG. 4
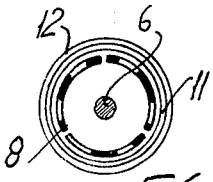
FIG. 5
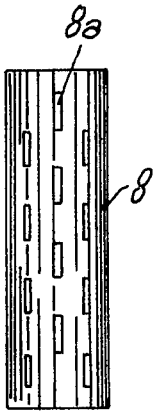
FIG. 6
FIG. 7
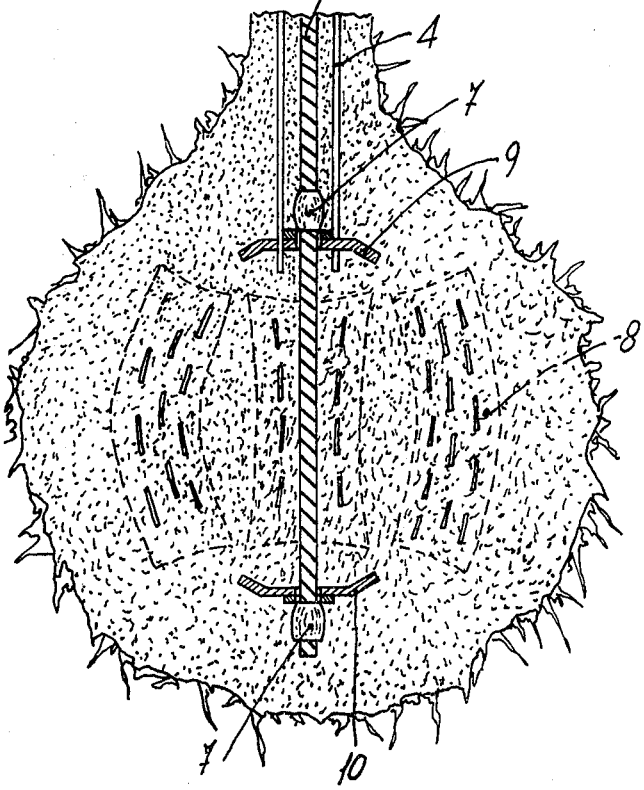

PROCESS FOR PROVIDING A FOUNDATION PILE FOR ALTERNATING COMPRESSIVE AND TRACTIVE STRESSES AND A PILE THUS PROVIDED

This invention relates to a foundation pile suitable to undergo alternating compressive and tractive loads.

Concrete foundation piles as cast on site are known, such piles being suitable to bear compressive loads. Also anchoring piles are known for taking up tractive stresses.

In some structures (for example, in trestles or latticeworks for electrical lines) the foundation piles are subjected at a substantial frequent rate to alternating compressive and tractive loads.

Thus, such piles are subjected to a serious fatigue state, to which hitherto known constructions do not provide a suitable resistance. So far foundation piles of this type have been made inserting one or more anchoring bars in the ground and then surronding them with concrete.

These conventional piles also presented a risk of corrosion of the inner anchoring bars, since any possible crack in the cement conglomerate cast around the bars would allow water to enter so that corrosion of said bars could take place.

It is the primary object of the present invention to ensure an efficient anchoring base to a pile for providing a prominent retaining effect also and particularly in grounds of a very poor quality.

It is a further object of the present invention to avoid corrosion in the anchoring bars.

In accordance with the present invention, the above cited primary object has been attained by the provision of making a pile according to the following procedure:

— a hole or bore is first drilled;

— one or more anchoring bars are inserted in said hole or bore, the lower ends of these bars being integral with a rigid, elongated and substantially cylindrical closed chamber which is impervious to liquids that from the outside would tend to penetrate inward, which chamber is connected to the outside by means of inlet tubes and in case vent tubes;

— the usual cast of concrete forming the actual pile is carried out;

— after concrete setting, cement grout is injected into said chamber with an increase in pressure until the side walls of the chamber break, allowing the cement grout to expand in the surrounding ground.

This chamber has the purpose of providing the mixture to be injected with a bigger space, so as to form a first "ball or pocket" which is pressed against the ground, expanding.

— After some time interval, but before the complete setting of the injected grout, the chamber is partially washed or scanvenged, so as to create again an injection chamber of suitable size.

— If required, cement grout is injected again and so on.

It is to be noted that the process according to the present invention, contemplating successive scavengings of the chamber, is made possible and facilitated by the provision of the specific chamber described. Thus, a chamber of a certain height enables the easy formation of an expansion chamber by means of reflux scavengings or washing with water. Repetition has the purpose of compensating for any shrinkages that the bulb or enlargement of expanded material could undergo in scarcely pervious or quite impervious grounds due to decantation. In pervious grounds repetition could be not essential.

The invention will now be better explained with reference to an exemplary embodiment as shown in the accompanying drawings, in which:

FIG. 3 is a longitudinal sectional view showing an end portion of the anchoring bars and cell before introduction thereof into the hole or bore;

FIG. 4 is a sectional view taken along line IV—IV of FIG. 3;

FIG. 5 is a sectional view taken along line V—V of FIG. 3;

FIG. 6 is a side view of the chamber according to the present invention as being secured to the anchoring bars; and FIG. 7 is a diagrammatic sectional view showing the end portion of a foundation pile according to the present invention upon completion.

Figure 1:
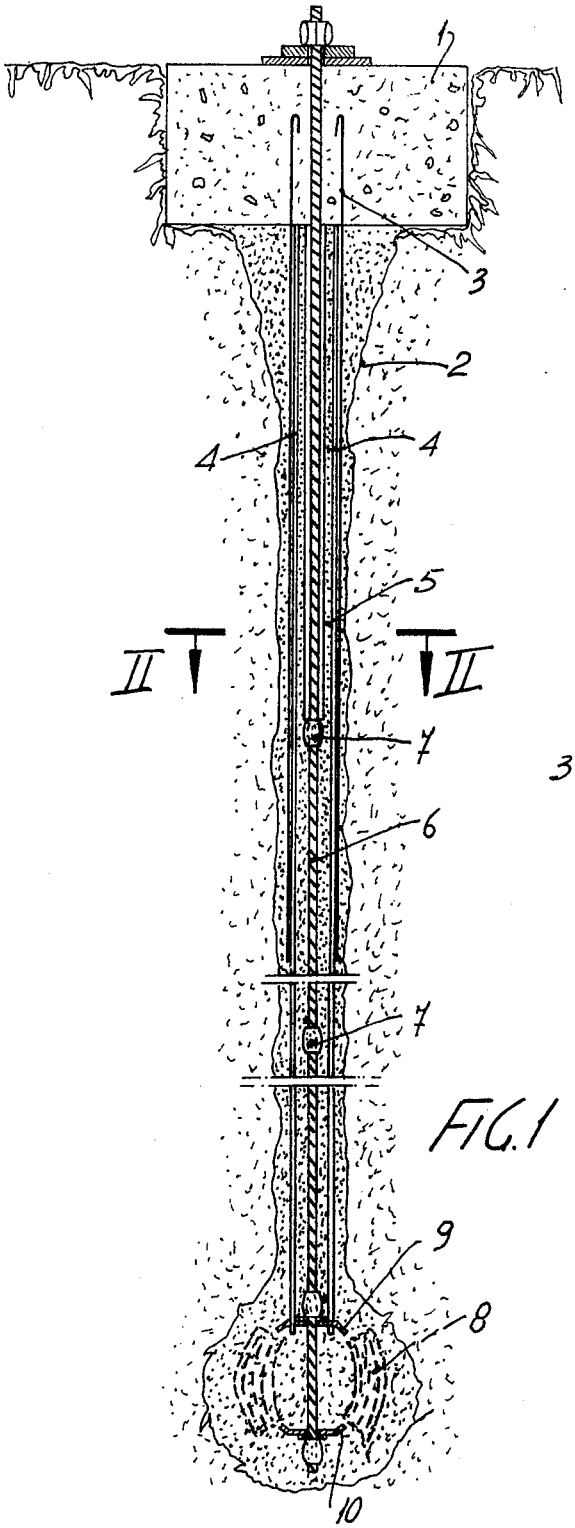
FIG. 1 is a longitudinal sectional view showing a pile as provided according to the present invention.
Figure 2:
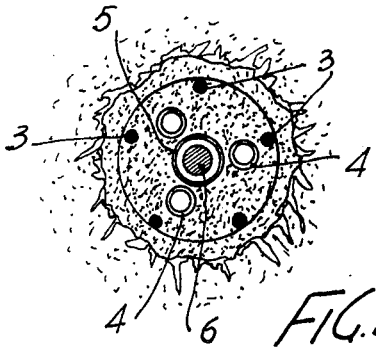
FIG. 2 is a cross-section taken along line II—II of FIG. 1.

The required operation sequence according to the present process will now be described:

— hole or bore 2 is drilled;

— reinforcement comprising an anchoring bar 6 and reinforcing bars 3 is inserted in bore 2, at the foot of this reinforcement is provided a cell or chamber including two nearly horizontal discs 9 and 10 (made integral with said anchoring bar 6 by means of fasteners 7) and a side wall 8 made of a lightweight sheet metal or other similar material. The side wall may be made of two or three pieces held together by a temporary fastening or the like. The assembly is enclosed within an enclosure made of jute cloth 11 or other equivalent material which in turn is covered by a plastic sheet 12 or other impervious material. Thus, the cell is impervious to the penetration from the outside of dense liquids (such as, drilling mud or conglomerates). The inside of the cell is connected to the surface by means of one or more small tubes 4;

— the pile cast is then carried out, the cell remaining protected by its double enclosure and thus is not flooded by the cement conglomerate;

— after concrete curing, an injection of cement grout is then effected into the cell through said small tubes 4. On pressing against the inner side walls of sheet metal, the grout will expand such walls, moving them away and breaking the plastic enclosure forming a bulb or enlargement;

— after a certain not complete curing period, the cell is partially scavenged or washed;

— a second injection into the ground is carried out;

— if required, scavengings or washings and injections are continued until the last injection is of a very reduced volume.

As an additional process, one of said small tubes 4 can be used as a vent tube partially throttling its outlet as grout is being introduced from another small tube 4. It will be seen that in this case a quite pure thin mortar outgoes therefrom. Also this system serves to thicken the mortar of cement intended to form the bulb or enlargement by removing part of the water therein.

A further additional step of the process according to the present invention consists of prestressing the pile head, particularly prestressing the top portion of the pile, so that the concrete cast about the reinforcing bars will not crack, and accordingly afford water penetration. In this case, the reinforcement bars 6 are provided at the top portion thereof with a sheath 5, whereby after pile casting a precompression can be effected in the desired length anchor block which provides for a relatively large area of bearing on the earth around the pile to facilitate post tensioning of same by applying tension to the rod 6. The sheath 5 enables the rod 6 to slide or stretch within the set concrete pile for post tensioning purposes, all as is known in the art.

The process is characterized in that said bulb or enlargement originates from an expansion chamber arranged in the device and strongly compressing the ground by expanding there against. Such an effect can occur also in sparingly pervious or totally impervious grounds, such as silt-clayish grounds. To this end, the distinct difference is to be noted between the process just described and a usual injection of cement, chemicals, etc. Thus, the usual injections from small orifices rather than from a suitably arranged expansion chamber, as in the device according to the present invention, can hardly clear a way into the surrounding ground, wherein therefore such a bulb or enlargement would either not be formed or would be formed with a highly reduced size.

The process, as so far described with reference to injections of cement grout, is also true and applicable to all of such cases where it would be deemed to use instead of said cement grout any other self-hardening binder, such as hardening chemicals, resins, etc.

What is claimed is:

1. A process for providing a foundation pile for alternating compressive and tractive stresses, comprising the steps of forming a bore in the ground, inserting in said bore an assembly of reinforcement bars, the lower end of which has secured thereto a chamber comprising two nearly flat discs vertically spaced apart from each other by a substantial distance, a perforated generally cylindrical and rupturable side wall extending between said discs and externally thereof an impervious coating, said assembly including at least two tubes extending into said chamber, casting concrete about said assembly and allowing it to set, whereupon injecting grout through at least one of said tubes into said chamber at such a pressure that the side walls of the chamber will break and the grout will expand laterally into the ground, then after a determined period, scavenging the chamber and then repeating said injections and scavenging until the volume taken up by the injections is minimized.

2. A process according to claim 1, wherein certain of said reinforcement bars of said assembly introduced into the ground are at the top portion thereof provided with loose sheaths, so as to allow for prestressing said concrete therearound.

3. A process according to claim 1, wherein during at least one of the injections of grout through said at least one tube, another of the tubes is used as a vent tube, throttling it until the grout outgoing therefrom contains more water than the injected grout.

4. For use in a concrete foundation pile, an insert device comprising an assembly of reinforcement rods having at one end means defining a loading cell, the top and lower walls of which comprise nearly flat discs fixedly secured to said reinforcement bar and arranged at a substantial distance apart, and the side walls of said cell comprising a perforated rupturable wall covered by an impervious coating.

5. A foundation pile according to claim 4, wherein externally of the side walls of said cell a layer of jute cloth is provided.

6. A foundation pile according to claim 4, wherein the perforated side wall comprises a sheet metal of at least two strips held together by temporary fastenings.

* * * * *